United States Patent [19]

Candler

[11] 4,170,436

[45] Oct. 9, 1979

[54] SCREW PUMPS WITH MODULAR CONSTRUCTION

[75] Inventor: Nigel D. Q. Candler, Hungerford, England

[73] Assignee: Sigmund Pulsometer Pumps Limited, Reading, England

[21] Appl. No.: 831,911

[22] Filed: Sep. 9, 1977

[51] Int. Cl.[2] ..... F04D 3/00

[52] U.S. Cl. ..... 415/73; 416/177

[58] Field of Search ..... 415/72, 73, 91; 416/177; 198/662, 664, 666, 676

[56] References Cited

U.S. PATENT DOCUMENTS

| | | | |
|---|---|---|---|
| 1,132,775 | 3/1915 | Hille | 416/177 |
| 1,142,089 | 6/1915 | Grimes | 416/177 |
| 1,150,408 | 8/1915 | Wilson | 416/177 |
| 1,196,696 | 8/1916 | Jones | 416/177 |
| 1,458,850 | 6/1923 | Rath | 416/177 |
| 1,484,945 | 2/1924 | Hill | 198/664 |
| 1,618,338 | 2/1927 | Hoffman | 416/177 |
| 4,019,830 | 4/1977 | Reid | 416/177 |

*Primary Examiner*—William L. Freeh
*Assistant Examiner*—Leonard E. Smith
*Attorney, Agent, or Firm*—Cushman, Darby & Cushman

[57] ABSTRACT

An archimedean screw pump is described comprising a cylindrical wall having at least one internal helicoidal vane fixed within it. The pump is built up from a plurality of like modules having helical and helicoidal portions which when assembled form the wall, the vanes, and other pump surfaces such as a ribbon core.

9 Claims, 9 Drawing Figures

SCREW PUMPS WITH MODULAR CONSTRUCTION

This invention relates to archimedean screw pumps and to a method of making such pumps.

Classical pumps of this type are well-known for their suitability for high volume, low lift pumping of water, and of matter with a high liquid to solids ratio, such as sewage.

These art pumps have been made in two basic forms, these comprising an open worm or screw which is rotated in a stationary trough of arcuate cross section, or a closed screw wherein a cylindrical tube surrounds and rotates with the screw. Both types suffer from many disadvantages; the former are costly to manufacture and transport and time consuming to install, they become progressively less efficient with use due to wear occurring at the screw-vane tips and the trough surfaces, and because under heavy loads the screws tend to warp out of alignment; the latter are proned to bearing and rigidity problems.

It is an object of the present invention to overcome these disadvantages and also to produce a cheaper, more adaptable, and generally more satisfactory screw pump system.

According to one aspect of the present invention an archimedean screw pump comprises a cylinder with one or more internal helicoidal vanes, the cylinder being built up from a plurality of modules each having a first portion constituting part of the cylinder wall and a second portion constituting part of a vane, the screw pump preferably being substantially coreless.

Each module may have a first and second portion as previously defined and a third portion depending from the inner helical edge of the second portion.

According to a further aspect of the invention a method of construction of an archimedean screw pump comprises assembling modules as defined above on a removable mandrel assembly, the pump preferably being built up from several discrete compatible cylindrical units assembled on a removable mandrel assembly. These cylindrical units preferably have radial flanges at their ends.

The first and second portions, and the third portions if present, of a module may be formed integrally with each other or be made separately and subsequently attached to each other.

Thus it is possible to build up a screw pump of any desired length by using the appropriate number of modules or number of cylindrical units. The modules themselves, or their constituent portions, may be of simple form with all the surfaces which will be in contact with the material being pumped readily accessible so that they can have a smooth surface finish and, if desired, be subjected to surface treatment before the modules are assembled together. This manner of construction is particularly suitable for manufacture using a polymeric plastics material (with or without glass-fibre or other reinforcement) the modules being formed in or on moulds or patterns.

The first portion of each module is preferably of a shape which, when developed into a plane, is a parallelogram. The smaller angles of the parallelogram may be equal to the helix angle of the vanes in a first module form or complementary thereto in a second module form. The second portion of each module preferably projects from a helical edge of the first portion. The third portion, if present, preferably depends from the inner edge of the helicoidal second portion, and is parallel to the first portion.

The pump may therefore be of the form wherein the first portions of each module are sealingly fixed at their edges to edges of up to four other adjacent modules to form a complete cylinder and the second portions are sealingly fixed at their ends to the ends of the second portions of one or two adjacent modules.

The third portions, when present, will be likewise sealed at their edges to edges of the third portions of one or two adjacent modules. In the first module form the third portion when present may conveniently have longitudinally aligned end edges which can be sealed to corresponding end edges of adjacent like modules. In the second module form the third portion when present may conveniently have circumferential end edges which can be sealed to corresponding end edges of adjacent like modules.

In these ways the second portions of a number of modules are joined in sequence to form the one or more complete helicoidal vane or vanes, the first portions are joined together to form the complete cylinder wall and the third portions when present are joined together to form a helical ribbon core.

The pump is preferably a three-start screw i.e. one which has three vanes. Each first module form may subtend in cross-section an angle of 120° at the axis of the cylinder, and each second module form, 240°.

The pump is preferably constructed so that the vanes do not extend inwards as far as the cylinder axis, and has no central core or shaft. The ribbon-core (when present) formed by the third portions may extend towards the upper end of the pump, the axial length of the ribbon core in the axial direction being less than the axial distance between adjacent vanes.

Fully-cored archimedean screw pumps of the closed type, in situations where the lower opening of the pump is completely immersed in the material to be raised, may be prone to intermittent interruptions of output, or "choking," even while the pump is still rotating and the lower end immersed. It has been found that the use of a ribbon-core substantially avoids this problem.

The pump cylinder may be supported for rotation on rolling-element bearings, pericyclic or epicyclic rollers, by hydrostatic bearing pads or on any other suitable means permitting rotation. The support means may act upon the pump cylinder or upon, within or against specially prepared tracks which may be formed on or attached to the outer surface of the pump cylinder or to fixed foundations.

The driving torque may be supplied by means which bear upon the outer surface of the pump cylinder or on the said tracks (if used) and may be applied via one or more of the supporting rollers (if used). The rollers may be provided with a tire with suitable friction characteristics or with a suitably toothed surface so as to ensure reliable rotation of the cylinder. In different operating circumstances other forms of drive independent of the support means such as a toothed belt, toothed wheel and chain or linear electric motor may be used to rotate the cylinder.

The pump may be provided with one or more external peripheral collars having radial flanges with which can cooperate one or more thrust bearings. The cooperation between the thrust bearing(s) and the flange(s) acts to prevent the cylinder from sliding down relative to the means which support it for rotation. The driving torque may be imparted to the cylinder through such a thrust bearing.

In operation the efficiency of the pump may be reduced by a flow of liquid matter over the lip of the cylinder at its upper end which trickles down the outside wall of the cylinder. To prevent this, suitable sealing means may be provided.

In an alternative the construction may involve completion of triple-module units each comprising three modules the helical portions of which subtend a total of 360° at the cylinder axis. An appropriate number, for example six of these triple units are then assembled on the mandrel to form a cylinder unit, thus ensuring consistent diametral measurements.

It is desirable that the ends of the cylinder units and of the complete cylinder are such that they key in planes perpendicular to the cylinder axis, and end modules so shaped may be used to fit into any end irregularities of the cylinder unit. For example, when a three-start screw with 120° helical module of the first form is used, the ends of the cylinder units will initially have three protruding points around each circumferential edge. One may therefore use specially prepared half-modules to fill the gaps to produce a planar "squared-off" end, or one may, for example, saw off the protruding points to produce the planar end and use the thus severed half modules to fill in the gaps between the protruding points at the other end, thus minimising waste of module material.

When modules of the second form are used there will be no protruding points as three modules sealed together will form a short cylinder having its ends in planes perpendicular to the cylinder axis.

Some specific embodiments of the present invention will now be described, by way of example, with reference to the accompanying drawings, in which.

Figures 1, 2:
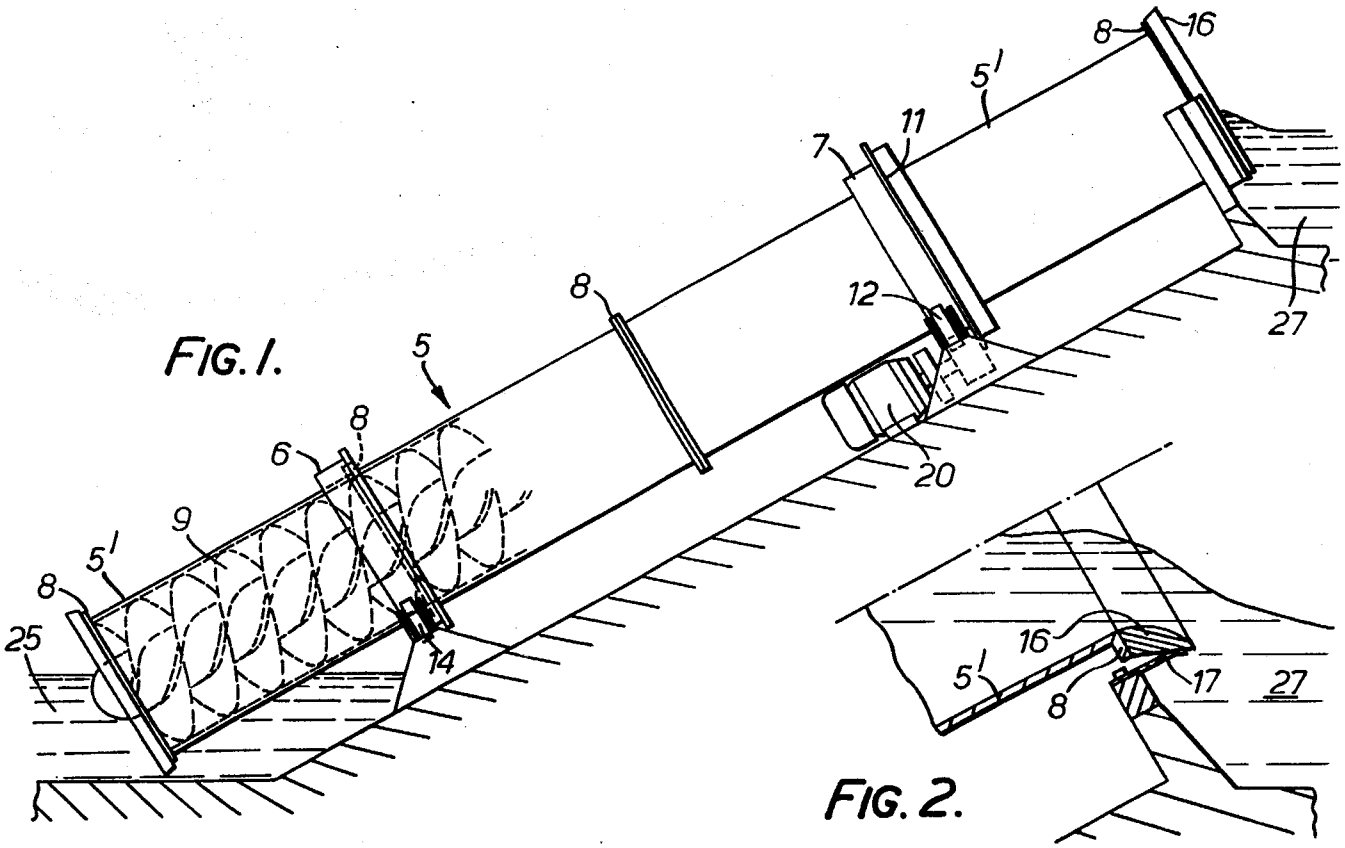
FIG. 1 is partly cut-away profile view of a screw pump installation.
FIG. 2 is an enlarged sectional view of a part of FIG. 1.
Figure 3:
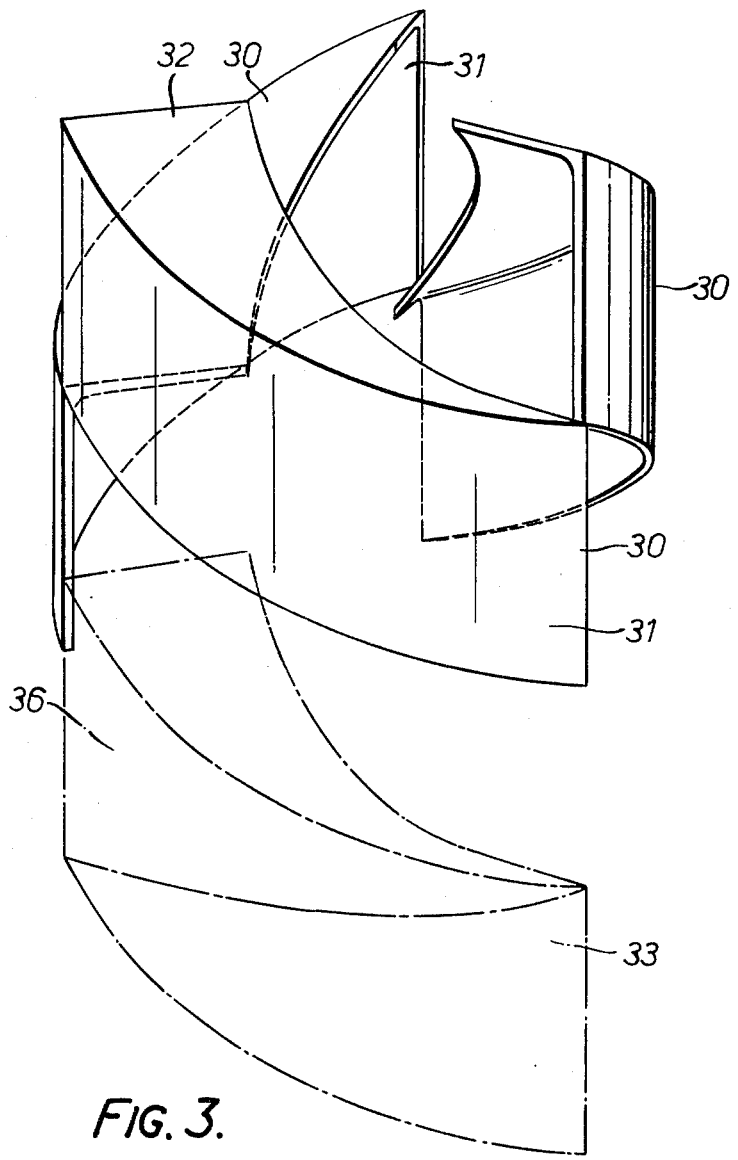
FIG. 3 is a perspective view of three modules of the first form from which a screw pump cylinder may be constructed.
Figure 4:
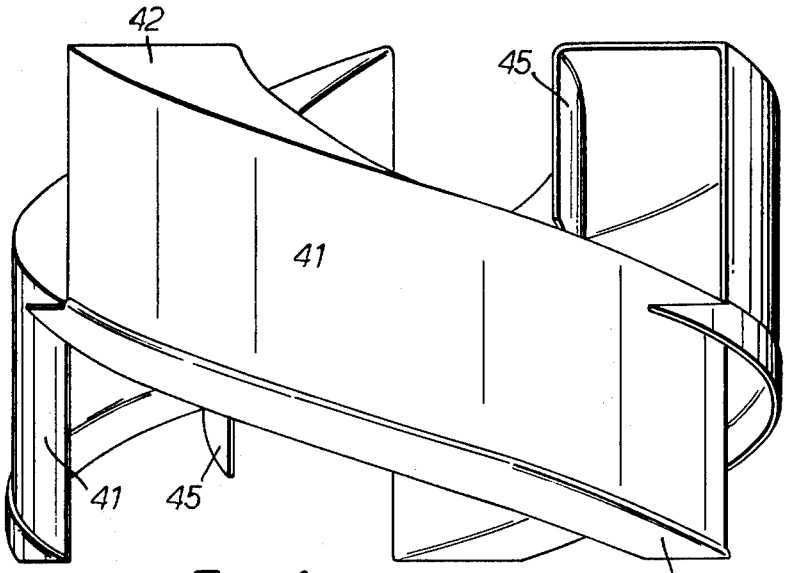
FIG. 4 is a perspective view of three further modules of the first form from which a screw pump cylinder may be constructed.
Figure 5:
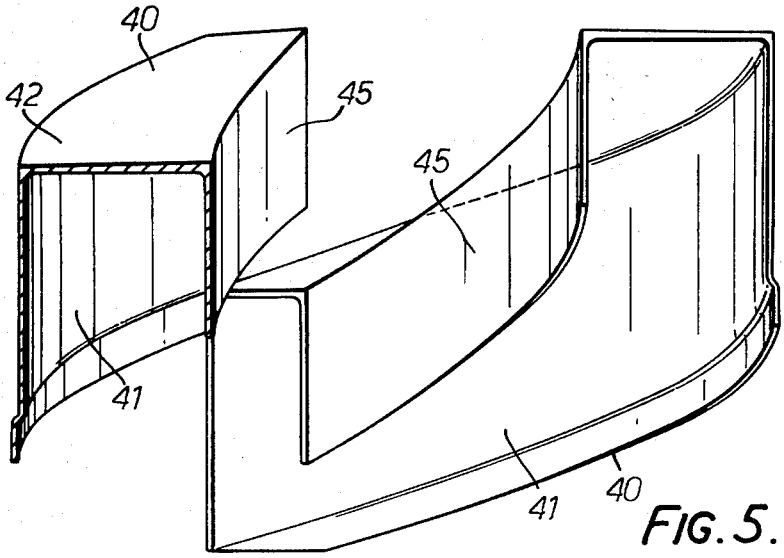
FIG. 5 is a view of a diametral plane section of FIG. 4.

Referring to the drawings, FIG. 1 shows an open ended cylindrical screw pump 5 comprising four identical smaller cylinder units 5' secured end to end in axial alignment. Each unit 5' is formed with a peripheral radial flange 8 at each end, whereby the units 5' may be attached to one another e.g. by bolts, to form the pump 5. Mounted around the pump 5 at the points of connection of the end units 5' to the middle units 5' are peripheral collars 6 and 7, both collars being secured to the appropriate flanges 8. The collar 7 has secured to it a radially extending flange member 11.

Each unit 5' has affixed to its inside surface three helical vanes 9 which extend the length of the unit 5' and which mate with the next corresponding vane 9 of an adjacent unit comprising the pump 5. These vanes 9 form together a three-start internal thread. The lower end of the pump 5 is open and in operation partially immersed in a liquid as shown at 25. Rotation of the pump 5 in the appropriate sense will cause some of the liquid 25 to be raised up between the rotating vanes 9 and eventually be expelled through the upper open end of the cylinder into the liquid shown at 27.

The pump 5 is supported for rotation with its axis at about 35° to the horizontal at two support stations 12 and 14 each comprising a pair of rollers. These rollers are mounted with their axes parallel to each other and to the cylinder axis of the pump 5 and are disposed on either side of the vertical plane through the cylinder axis so as to subtend thereat an angle of about 90°. Thrust bearing rollers (not shown) are provided at the support station 12 bearing against the flange 11 of collar 7 to maintain collars 6 and 7 in alignment with their respective roller stations 14 and 12.

An electric motor 20 is provided to drive a toothed belt which engages a track on the outer wall of the pump 5 in order to effect the necessary rotation thereof.

The upper open end of the pump 5 has secured to its peripheral flange 8 a rigid lip 16. A flexible arcuate lip seal 17 is mounted so as to bear up against the lip 16 to provide a seal to prevent substantial back-flow of liquid 27 down the outside of the pump 5. The lip seal 17 is adjustably mounted so that wear can be accommodated and the seal maintained in contact with the lip 16. It will be seen that the pressure of liquid 27 forces the seal 17 against the lip 16. This arrangement can be seen best in FIG. 2.

Each cylinder unit 5' is built up from eighteen modules 30. Each of the modules 30 is a one-piece, glass-fibre reinforced plastics moulding comprising two portions with a common edge. The first portion 31 forms part of a cylinder wall and subtends 120° at the cylinder axis. It has two linear edges which run parallel to the cylinder axis and two other edges which run parallel to each other, each forming part of a helix. This portion 31 is thus of a shape which, when developed into a plane, is a parallelogram, the small angle of which is the helix angle.

Along one of its helical edges this portion 31 is connected to a second, helicoidal portion 32 the end edges of which run along radii of the cylinder, and the inner edges of which stop some way short of the cylinder axis.

Each pump cylinder unit 5' is therefore formed of the eighteen modules seated together, the helical edges and the linear edges of a helical portion 31 of a module 30 being sealed with adhesive to corresponding edges of up to four adjacent modules 30 and the end edges of the helicoidal portion 32 being sealed to corresponding edges of one or two adjacent modules 30, whereby the cylinder wall is built up from the sealed helical portions 31 and the three helicoidal vanes 9 are built up from the helicoidal portions 32.

The three modules 30 at each end of a unit 5' thus formed obviously require "squaring-off" as their first portions 31 each have two free edges. This may conveniently be done by sawing from the bottom end the three triangular projections 33 of portions 31 of the end modules 30 on a plane perpendicular to the cylinder axis to provide one "squared-off" end. The three cutoffs are half-helical portions, i.e. shapes which, if developed into a plane, would be right-angled triangles. These "triangles" 33 may then be sealed in the triangular gaps which result at the other end of the cylinder unit 5', to provide the "squared-off" other end. The flanges 8 are secured to the thus "squared-off" ends.

A resin impregnated wrapping is wound around a complete cylinder unit 5' to impart further rigidity, and further reinforcement may be bonded into the cylinder unit at intervals.

In a further embodiment a similar screw pump is built up from modules 40. These modules 40 have first and second portions 41 and 42 which correspond to portions 31 and 32 of the modules 30 and have further a core flange 45 depending from the inner helical edge of the said second portion 42. The flange 45 is disposed parallel to the first portion 41 and such that when a plurality of modules 40 are placed together to form a pump cylinder the combined flanges produce a partial or "ribbon core" extending towards the upper end of the pump. The flanges 45 are of such a length in an axial direction that each flange 45 stops short of the helicoidal second portion of its next axially neighbouring modules 40. The "ribbon core" type of screw pump has been found to be functionally advantageous. Edges of the modules which are required to mate with edges of other adjacent modules may be offset or have overlapping lips for ease of alignment and connection.

Cylinder units 5' when made of modules 40 may conveniently be constructed with the ends squared off only as regards the portions 41 and 42, leaving "triangular" gaps at one end and protrusions at the other formed by the core flanges 45. This can assist the mating together of adjacent cylinder units 5' to form a complete pump 5 having a continuous ribbon-type core.

Figure 8:
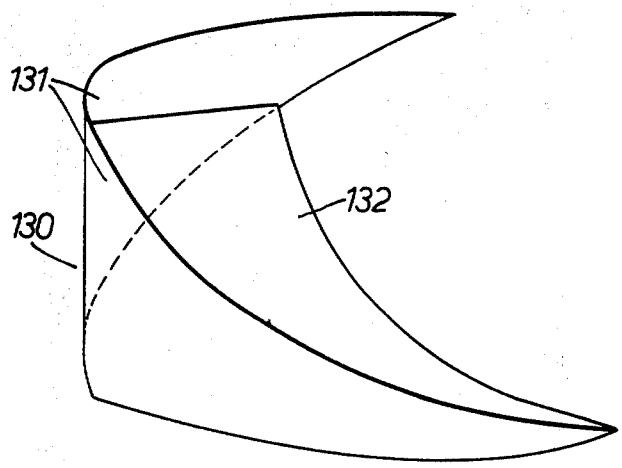
FIG. 8 is a perspective view of a module of the second form from which a screw pump cylinder may be constructed.
Figure 9:
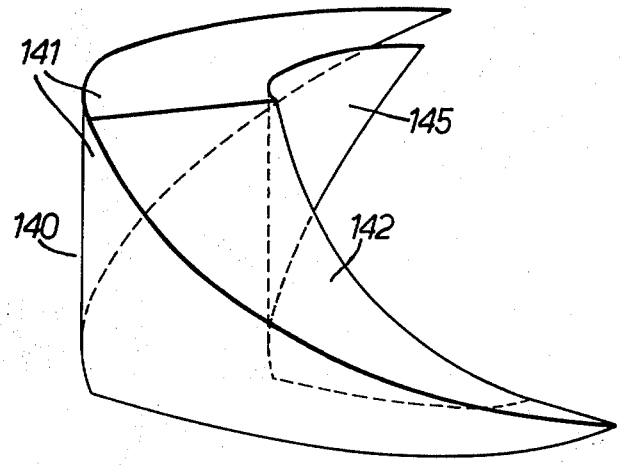
FIG. 9 is a perspective view of a further module of the second form from which a pump cylinder may be constructed.

In yet a further embodiment similar screw pumps may be built up from modules 130 or 140—see FIGS. 8 and 9. The first portions 131 and 141 of those modules have two circumferential edges which lie in a plane normal to the cylinder axis and two other edges which run parallel to each other, each forming part of a helix. The portions 131 and 141 are thus of a shape which, when developed into a plane, is a parallelogram, the small angle of which is complementary to the helix angle. The second portions 132 and 142 correspond to second portions 32 and 42.

Referring to FIG. 9 a third portion or core flange 145 depends from the inner helical edge of portion 142 of the module 140 such that when a plurality of modules 140 are placed together to form a pump cylinder, the combined flanges produce a partial or ribbon core extending towards the upper end of the pump. The flanges 145 are of the same shape as the portions 140, but smaller.

It is contemplated that any number of modules 30, 40, 130 or 140 could be assembled with other like modules to provide a unit 5' of any desired length and that any number of the units 5' may be joined together to produce a screw pump such as 5. Pumps such as 5 may be supported on as many support stations as appear necessary to the proposed use of the particular pump. Furthermore any suitable drive means or drive transfer means may be used to effect rotation of such screw pumps, and the support stations may comprise in addition to or replacement of the said rollers any other means permitting rotation, including hydrostatic bearing pads.

It is further contemplated that the pump cylinder 5 may be provided with a flexible annular flange projecting from a peripheral collar at its upper end, which flange makes liquid sealing contact with a fixed arcuate seal member having a centre of curvature on the pump cylinder axis. This is an alternative to the sealing means described above with reference to FIG. 2.

Figure 6:
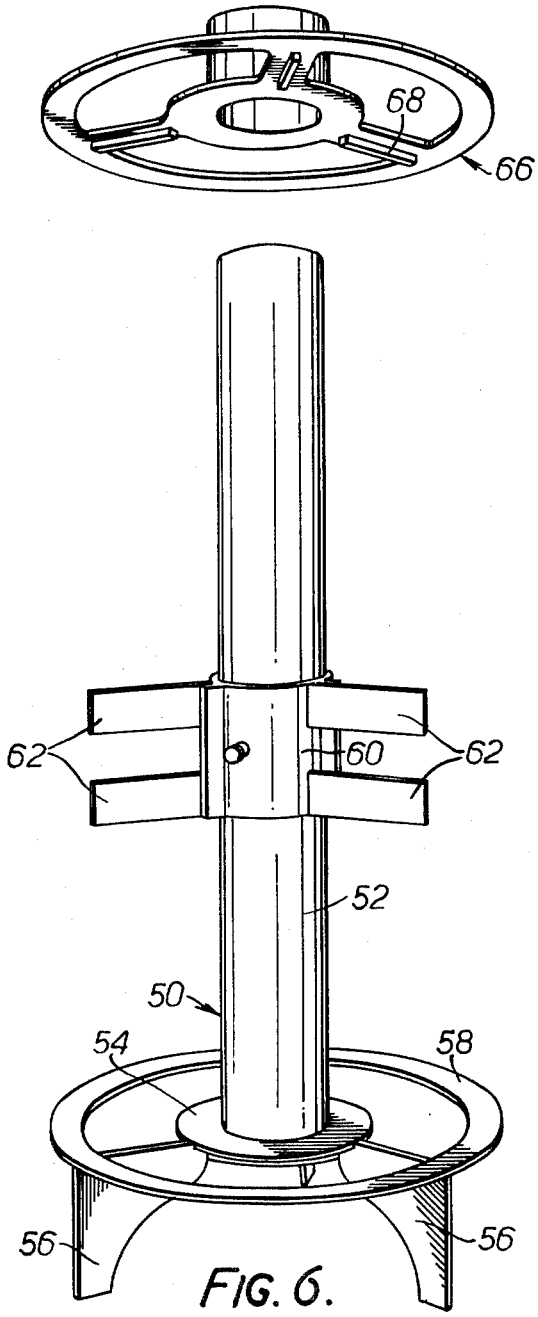
FIG. 6 is a perspective view of a jig assembly upon which screw pumps may be constructed from the modules as shown in FIG. 3 or FIGS. 4 and 5.
Figure 7:
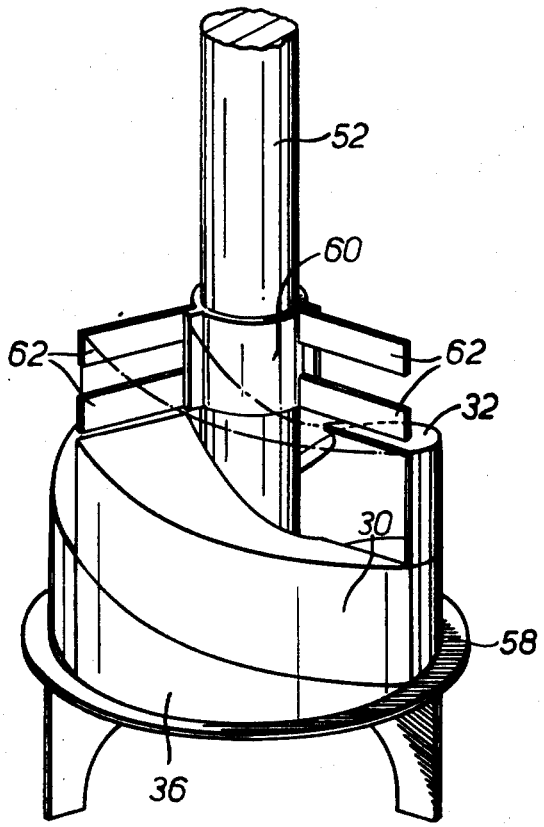
FIG. 7 is a perspective view of the jig assembly of FIG. 5 with a screw pump partially assembled thereon.

The cylinder units 5' may conveniently be made according to the following method. Referring to FIGS. 6 and 7 a jig 50 comprises a cylindrical mandrel 52 having a radial flange 54 at its lower end. The flange 54 is supported by three spaced leg members 56, each having an accurate radial location face, to which leg members 56 is also secured an annulus 58 concentric with the flange 54. The internal diameter of annulus 58 corresponds to the internal diameter of the cylinder wall of a unit 5'.

The assembly will now be described in respect of a cylinder unit 5' comprising a plurality of modules 30. It will be appreciated that substantially the same considerations apply when constructing a unit 5' from modules 40.

To commence the assembly, three modules 30 are cut to remove their three "triangular" projections 33 of their portions 31. The remaining half modules 36 are clamped to the annulus 58. The upper longitudinal edge of each first portion 31 and the upper radial edge of each second portion 32 of each second portion 32 of each half modules 36 are located against flat arms 62 of a spider unit 60 mounted on the mandrel 52, which arms 62 are disposed radially of the mandrel axis. The lower radial edges of each half module 36 are accurately located against the said accurate radial location of the appropriate leg member 56. Once the three half modules 36 have thus been located the spider unit 60 is lifted up the mandrel 52 and secured by means of a peg or pinch bolt (not shown) in a predetermined position where it is correctly situated to enable the arms 62 to locate similarly the corresponding edges of three modules 30, such that the lower edges of the three modules 30 are touching or in close juxtaposition to the upper edges of the half modules 36. The thus located modules 30 are then secured by bonding to the adjacent half modules 36. Once the bonding has set the spider unit 60 is again lifted vertically to a next predetermined position on the mandrel 52 for location of subsequent modules 30. When the desired number of modules 30, in this case fifteen, have been thus located and bonded to one another and to the three half modules 36, the spider unit 60 is removed entirely from the jig assembly 50 and the off cut "triangular" projections 33 are inserted into the triangular gaps which remain between the last, upper modules 30 and are bonded therein.

A jig plate 66 fits accurately on the mandrel 52. The plate 66 has three accurate radial faces 68 adapted to locate on the exposed upper radial edges of the second portions 32 of the last upper modules 30.

Once the plate 66 is in position the entire cylinder unit 5' thus produced, effectively comprising eighteen modules 30, is wrapped with a reinforcing web which is then bonded to the outer surface of the cylinder. The web is extended outwardly at the ends of the unit over the plate 66 and the annulus 58 so as to produce the flanges 8. When set, the flanges 8 are drilled through suitable aligned bushings in the annulus 58 and the jig plate 66. The drillings ensure that subsequent accurate alignment of units 5′ can easily be effected to form a screw pump 5.

As implied above the foregoing description varies little when modules 40 are substituted for modules 30. The principal difference is that the projections of the third portions 45 are not cut off at the lower end of the unit and protrude below the level of the flange 54 and annulus 58. When making a pump cylinder from units 5′ built from modules 40 these projections extend into the corresponding spaces in the adjacent unit 5′.

It will be appreciated that the modules 30 or 40 may be constructed integrally or from their constituent portions and subsequently bonded together.

When using modules 130 or 140 a jig assembly similar to that described above may be used with appropriate modifications to the positions of the accurate location surfaces. It will be appreciated that no spider unit 60 is necessary.

What I claim as my invention and desire to secure by Letters Patent is:

1. A module for forming, together with a number of like modules, an archimedean screw pump, having a cylinder wall and at least one internal helicoidal vane, said module comprising a first portion forming part of the wall of a cylinder and a second helicoidal portion projecting inwardly from said first portion, said second portion constituting part of a helocoidal vane upon assembly of like modules to form said pump.

2. A module as claimed in claim 1 having a third portion parallel to said first portion projecting from said second portion, said third portion constituting upon assembly of the modules to form the pump, part of a helical partial core.

3. An archimedean screw pump comprising a pump cylinder having at least one internal, helicoidal vane, said pump being constituted from a plurality of individual modules, each module having a first portion constituting part of a cylinder wall and a second portion constituting part of a vane, said modules being joined together to define said cylinder and said helicoidal vane.

4. An archimedean screw pump as claimed in claim 3 wherein said pump is built up from a plurality of interfitting like modules, each of said modules comprising a first cylinder wall portion of a shape which when developed into a plane is a parallelogram and a second vane portion which projects from said first portion, said plurality of first portions forming said cylinder wall, and said plurality of second portions forming said at least one vane.

5. An archimedean screw pump as claimed in claim 3 which is substantially coreless.

6. An archimedean screw pump as claimed in claim 3 wherein a third portion parallel to said first portion projects from said second portion of each module, said plurality of said third portions forming a helical flange which describes a helical partial core coaxial with said pump cylinder wall.

7. An archimedean screw pump as claimed in claim 3 having a peripheral collar at its upper end which bears against a fixed flexible arcuate seal.

8. An archimedean screw pump as claimed in claim 3 having a flexible peripheral collar at its upper end which bears against a fixed arcuate seal member.

9. A pump as claimed in claim 3 wherein said plurality of modules are assembled on a mandrel assembly and are bonded to one another to form the pump.

* * * * *